US012378868B2

(12) United States Patent
Zejli et al.

(10) Patent No.: US 12,378,868 B2
(45) Date of Patent: Aug. 5, 2025

(54) CLOSED-LOOP AUTOMATION OF WELL OPERATIONS

(71) Applicant: Chevron U.S.A. Inc., San Ramon, CA (US)

(72) Inventors: Amine Zejli, Houston, TX (US); Johannes Cornelis Visser, Midland, TX (US); Tomislav Basic, Grad Zagreb (HR); Kendall Caldwell Farrell, Carlsbad, NM (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 18/321,638

(22) Filed: May 22, 2023

(65) Prior Publication Data

US 2024/0392675 A1 Nov. 28, 2024

(51) Int. Cl.
*E21B 44/00* (2006.01)

(52) U.S. Cl.
CPC ..... *E21B 44/00* (2013.01); *E21B 2200/20* (2020.05)

(58) Field of Classification Search
CPC ..... E21B 44/00; E21B 2200/20
See application file for complete search history.

(56) References Cited

U.S. PATENT DOCUMENTS

| | | | | |
|---|---|---|---|---|
| 9,031,674 | B2 * | 5/2015 | Rashid | E21B 43/00 700/32 |
| 9,951,601 | B2 * | 4/2018 | Rashid | E21B 47/008 |
| 11,493,665 | B1 * | 11/2022 | Putcha | E21B 43/00 |
| 11,501,043 | B2 * | 11/2022 | Sankaran | G06F 30/28 |
| 11,795,787 | B2 * | 10/2023 | Sandnes | G06F 30/27 |
| 11,821,289 | B2 * | 11/2023 | Bukhamseen | G05B 17/00 |
| 2008/0154564 | A1 * | 6/2008 | Rashid | E21B 43/122 703/10 |
| 2010/0042458 | A1 * | 2/2010 | Rashid | E21B 43/122 703/10 |
| 2012/0215364 | A1 * | 8/2012 | Rossi | E21B 43/121 700/281 |
| 2020/0240259 | A1 * | 7/2020 | Balasubramaniam | E21B 47/06 |
| 2022/0389798 | A1 * | 12/2022 | Liu | E21B 44/00 |

FOREIGN PATENT DOCUMENTS

| | | | |
|---|---|---|---|
| WO | WO-2023278745 | A1 * | 1/2023 |
| WO | WO-2023164526 | A1 * | 8/2023 |

* cited by examiner

*Primary Examiner* — Tara Schimpf
*Assistant Examiner* — Ursula Lee Norris
(74) *Attorney, Agent, or Firm* — Esplin & Associates, PC

(57) ABSTRACT

A closed-loop automation tool models individual wells in a field and connections between the wells in the field. Field measurements are used to validate and calibrate the models. The tool updates values of operation parameters of the wells, such as gas lift gas rate for gas lift wells and electrical submersible pump frequency for electrical submersible pump wells. The updated values are used to increase the efficiency of the wells and increase production with minimum human intervention.

20 Claims, 5 Drawing Sheets

CLOSED-LOOP AUTOMATION OF WELL OPERATIONS

FIELD

The present disclosure relates generally to the field of controlling operations of multiple wells.

BACKGROUND

Operation parameters of a well may need to be updated to ensure efficiency of the well for oil production. As the number of wells in a field increases, manually updating the operation parameters of the wells may be time-consuming, resulting in lost production opportunity and inefficient performance of the wells.

SUMMARY

This disclosure relates to controlling operation of multiple wells. Well model information, field model information, field measurement information, and/or other information may be obtained. The well model information may define well models for multiple wells in a field. The field model information may define a field model for the field. The field model may simulate connections between the multiple wells in the field. The field measurement information may define operation characteristics of the multiple wells in the field. The well models for the multiple wells in the field may be calibrated based on the field measurement information and/or other information. The field model may be calibrated based on the field measurement information and/or other information. Values of operation parameters for the multiple wells in the field may be determined based on the calibrated well models, the calibrated field model, and/or other information. Automatic operations of the multiple wells in the field may be facilitated based on the determined values of the operation parameters and/or other information.

A system for controlling operation of multiple wells may include one or more electronic storage, one or more processors and/or other components. The electronic storage may store well model information, information relating to well models, information relating to wells, field model information, information relating to a field model, information relating to a field, field measurement information, information relating to operation characteristics of wells, information relating to calibration of well models, information relating to calibration of field models, information relating to operation parameters for wells, information relating to automatic operations of wells, and/or other information.

The processor(s) may be configured by machine-readable instructions. Executing the machine-readable instructions may cause the processor(s) to facilitate controlling operation of multiple wells. The machine-readable instructions may include one or more computer program components. The computer program components may include one or more of a well model component, a field model component, a field measurement component, a well model calibration component, a field model calibration component, an operation parameter component, an operation component, and/or other computer program components.

The well model component may be configured to obtain well model information and/or other information. The well model information may define well models for multiple wells in a field.

The field model component may be configured to obtain field model information and/or other information. The field model information may define a field model for the field. The field model may simulate connections between the multiple wells in the field.

The field measurement component may be configured to obtain field measurement information and/or other information. The field measurement information may define operation characteristics of the multiple wells in the field. In some implementations, the field measurement information may include real time sensor measurements, well test measurements, and/or other measurements.

The well model calibration component may be configured to calibrate the well models for the multiple wells in the field. The well models for the multiple wells in the field may be calibrated based on the field measurement information and/or other information.

In some implementations, calibration of a given well model for a given ESP well in the field based on the field measurement information may include determination of an ESP pump's gas separation efficiency and wear factor for the given well model.

In some implementations, calibration of a given well model for a given well in the field based on the field measurement information may include determination of a vertical lift performance correlation for the given well model based on comparison between pressure drop in a tubing simulated by the given well model and measured tubing pressure drop of the given well and/or other information.

In some implementations, calibration of a given well model for a given well in the field based on the field measurement information may include adjustment of reservoir pressure and productivity index for the given well model based on a measured operating point of the given well and/or other information. In some implementations, one or more inflow performance relationship calibration rules may define extent of reservoir pressure and productivity index adjustment based on the measured operating point of the given well and/or other information.

The field model calibration component may be configured to calibrate the field model for the field. The field model for the field may be calibrated based on the field measurement information and/or other information.

The operation parameter component may be configured to determine values of operation parameters for the multiple wells in the field. The values of operation parameters for the multiple wells in the field may be determined based on the calibrated well models, the calibrated field model, and/or other information. In some implementations, the operation parameters for the multiple wells in the field may include gas lift gas rate for gas lift wells and/or electrical submersible pump frequency for electrical submersible pump wells.

In some implementations, determination of the values of the operation parameters for the multiple wells in the field based on the calibrated well models and the calibrated field model may include determination of values of gas lift gas rate for gas lift wells and/or values of electrical submersible pump frequency for electrical submersible pump wells that increase production from the field while adhering to constraints at individual wells, individual production headers, and individual central tank batteries in the field.

In some implementations, determination of the values of the operation parameters for the multiple wells in the field based on the calibrated well models and the calibrated field model may include determination a performance curve tree for the field. The performance curve tree may include performance curves for individual wells, individual production headers, and individual central tank batteries in the field. A performance curve for a well may be determined based on isolation of a well model corresponding to the well in the field model and calculation of liquid rate at different gas lift gas rates. A performance curve for a production header may be determined based on incremental distribution of gas lift gas rates among wells connected to the production header. A performance curve for a central tank battery may be determined based on incremental distribution of gas lift gas rates among production headers connected to the central tank battery.

The operation component may be configured to facilitate automatic operations of the multiple wells in the field. The automatic operations of the multiple wells in the field may be performed based on the determined values of the operation parameters and/or other information. In some implementations, facilitation of the automatic operations of the multiple wells in the field based on the values of the operation parameters may include automatically changing values of the gas lift gas rate for the gas lift wells and/or values of the electrical submersible pump frequency for the electrical submersible pump wells.

These and other objects, features, and characteristics of the system and/or method disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a," "an," and "the" include plural referents unless the context clearly dictates otherwise.

DETAILED DESCRIPTION

The present disclosure relates to controlling operation of multiple wells. A closed-loop automation tool models individual wells in a field and connections between the wells in the field. Field measurements are used to validate and calibrate the models. The tool updates values of operation parameters of the wells, such as gas lift gas rate for gas lift wells and electrical submersible pump frequency for electrical submersible pump wells. The updated values are used to increase the efficiency of the wells and increase production with minimum human intervention.

Figure 1:
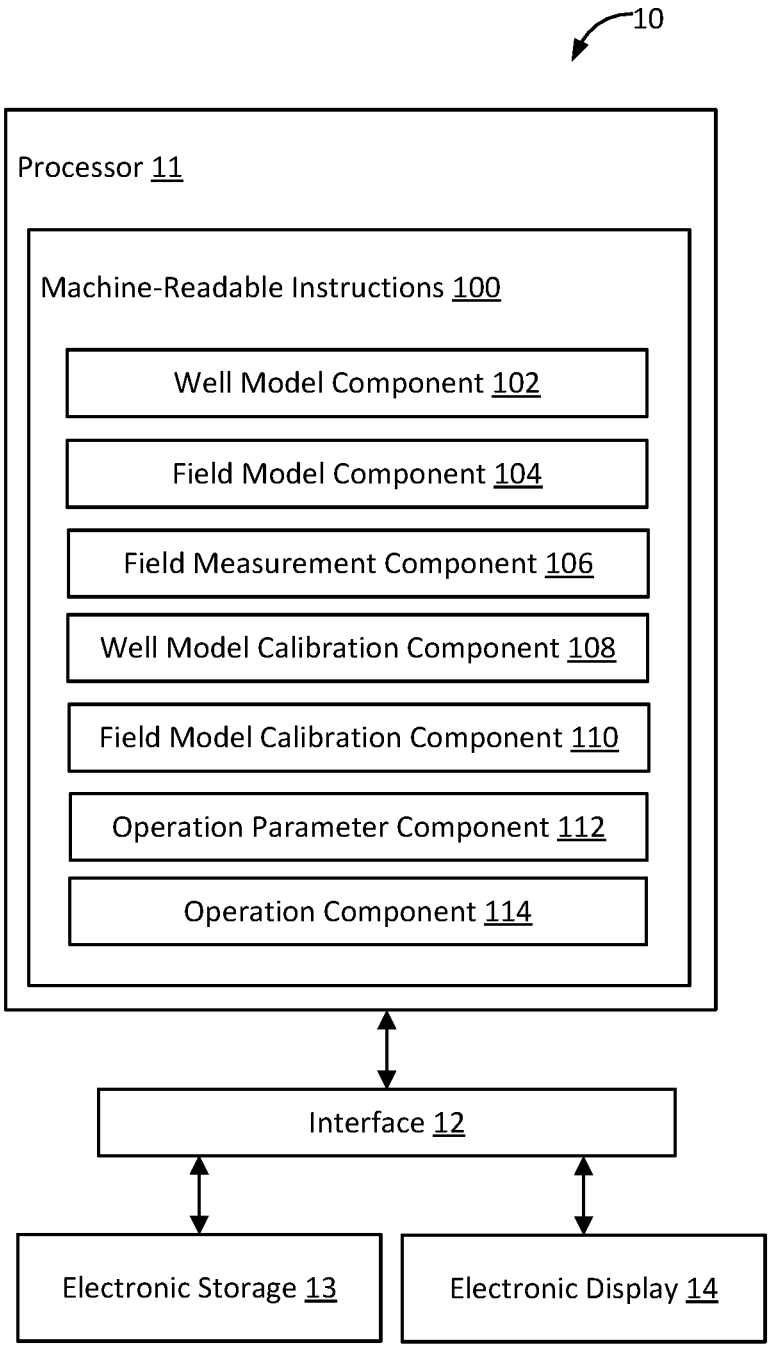
FIG. 1 illustrates an example system for controlling operation of multiple wells.

The methods and systems of the present disclosure may be implemented by a system and/or in a system, such as a system 10 shown in FIG. 1. The system 10 may include one or more of a processor 11, an interface 12 (e.g., bus, wireless interface), an electronic storage 13, an electronic display 14, and/or other components. Well model information, field model information, field measurement information, and/or other information may be obtained by the processor 11. The well model information may define well models for multiple wells in a field. The field model information may define a field model for the field. The field model may simulate connections between the multiple wells in the field. The field measurement information may define operation characteristics of the multiple wells in the field. The well models for the multiple wells in the field may be calibrated by the processor 11 based on the field measurement information and/or other information. The field model may be calibrated by the processor 11 based on the field measurement information and/or other information. Values of operation parameters for the multiple wells in the field may be determined by the processor 11 based on the calibrated well models, the calibrated field model, and/or other information. Automatic operations of the multiple wells in the field may be facilitated by the processor 11 based on the determined values of the operation parameters and/or other information.

The electronic storage 13 may be configured to include electronic storage medium that electronically stores information. The electronic storage 13 may store software algorithms, information determined by the processor 11, information received remotely, and/or other information that enables the system 10 to function properly. For example, the electronic storage 13 may store well model information, information relating to well models, information relating to wells, field model information, information relating to a field model, information relating to a field, field measurement information, information relating to operation characteristics of wells, information relating to calibration of well models, information relating to calibration of field models, information relating to operation parameters for wells, information relating to automatic operations of wells, and/or other information.

The electronic display 14 may refer to an electronic device that provides visual presentation of information. The electronic display 14 may include a color display and/or a non-color display. The electronic display 14 may be configured to visually present information. The electronic display 14 may present information using/within one or more graphical user interfaces. For example, the electronic display 14 may present well model information, information relating to well models, information relating to wells, field model information, information relating to a field model, information relating to a field, field measurement information, information relating to operation characteristics of wells, information relating to calibration of well models, information relating to calibration of field models, information relating to operation parameters for wells, information relating to automatic operations of wells, and/or other information.

With growing number of wells and other production facilities in a field, the manual management of operations in the reservoir becomes more complicated, time-consuming, difficult, and costly and require more personnel. With large number of wells and other production facilities in a field, manual management of operations in the field, such as valve operation, well-by-well optimization, and troubleshooting, becomes impractical. For example, with large number of wells, it would take too long to react to changes in the wells/reservoir by manually computing and inputting setpoints for different wells (e.g., gas lift gas rate for gas lift wells and/or electrical submersible pump frequency for electrical submersible pump wells).

The present disclosure provides a tool that enables system-wide optimization of artificially lifted wells with remote control and ability to close-loop optimize. The system includes wells and facilities in a field. The tool provides system wide closed-loop calibration and optimization of artificially lifted wells, enables automation of previous manual tasks, and allows for remote operation of the wells from a central location, resulting in accelerated production optimization, increased production and reduced lost production opportunities. The closed-loop process of the current disclosure enable automatic control of the wells in the field with improved production.

To improve production from a reservoir (e.g., increase production, maximize production, increase efficiency of production, optimize production), history matching is used to obtain well models that matches historical data (e.g., historical sensor measurements, well test measurement) of the wells in the reservoir. The well models are validated using real time data (e.g., current field measurements, most recent field measurements) of the wells, and the well models are calibrated if the simulations from the well models do not match the real time data. This ensures that the well models accurately simulate present conditions in the wells/reservoir. The validated/calibrated well models are used to find values of operation parameters for the wells (e.g., setpoints, gas lift gas rate and/or electrical submersible pump frequency, choke settings) that improve production from the wells. The values of operation parameters for the wells may be sent directly to control devices in the reservoir to automate changes in operation of the wells. Direct transfer of the values of operation parameters for the well to the control devices in the reservoir may enable automation of well operations and enable control of the wells with reduced/minimal human intervention.

Figure 3:
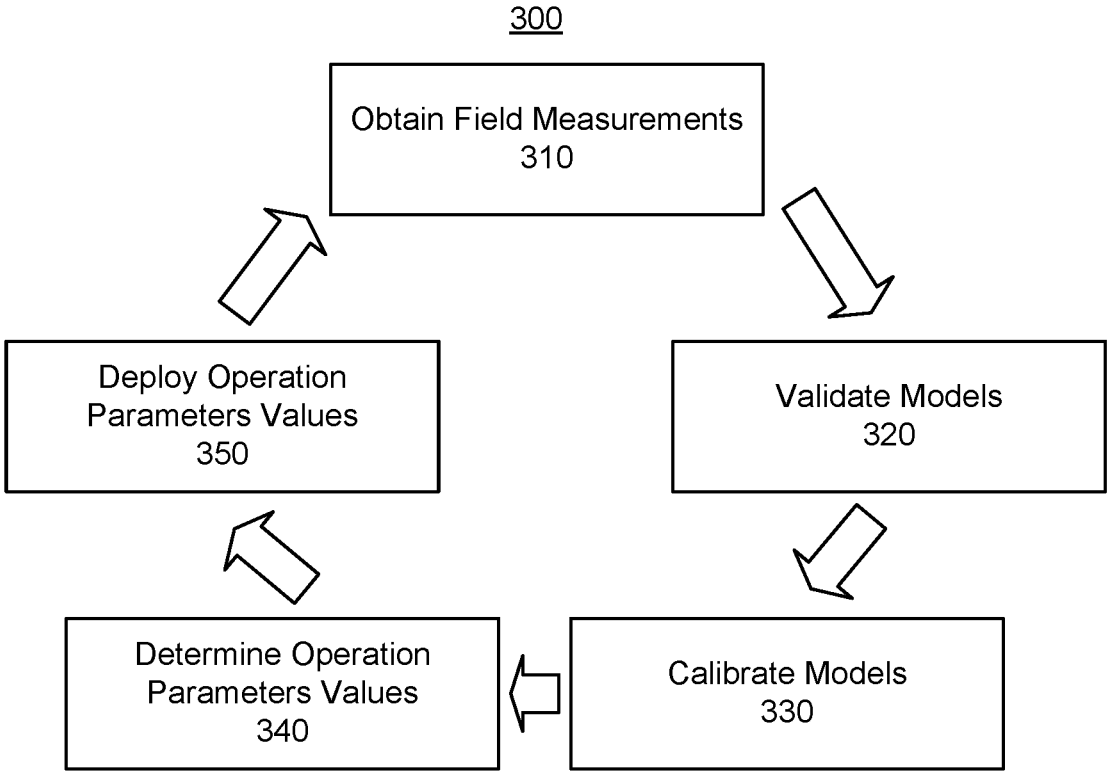
FIG. 3 illustrates an example flow diagram for controlling operation of multiple wells.

FIG. 3 illustrates an example flow diagram 300 for controlling operation of multiple wells in a field. At step 310, field measurements (e.g., real time sensor measurements, well test measurements) for the wells may be obtained. At step 320, models for the wells may be validated using the field measurements. Simulation results of the models for the well may be compared to the field measurements. Based on the simulation results matching the field measurements (e.g., being the same, difference being within threshold amount), the models may be validated. Based on the simulation results not matching the field measurements (e.g., not being the same, difference exceeding threshold amount), the models may be calibrated at step 330 using the field measurements. At step 340, the validated and/or calibrated models may be used to determine operation parameter values for the field. The operation parameter values may be determined to improve production from the field (e.g., increase production, maximize production, increase efficiency of production, optimize production). For example, the validated and/or calibrated models may be used to determine optimal setpoints for gas lift gas rate for gas lift wells and/or electrical submersible pump frequency for electrical submersible pump wells. The operation parameter values may be determined while controlling the models/simulations to respect one or more constraints. For example, the constraint(s) may place boundary/limit on optimizing setpoints for the wells. At step 350, the operation parameter values may be deployed in the field. For example, the setpoints (e.g., optimized setpoints) may be sent to the field for use to improve production while respecting the constraint(s) at the wells/in the field. The flow diagram 300 may return to step 310, where new/more recent field measurements may be obtained, and the process repeats.

Figure 4:
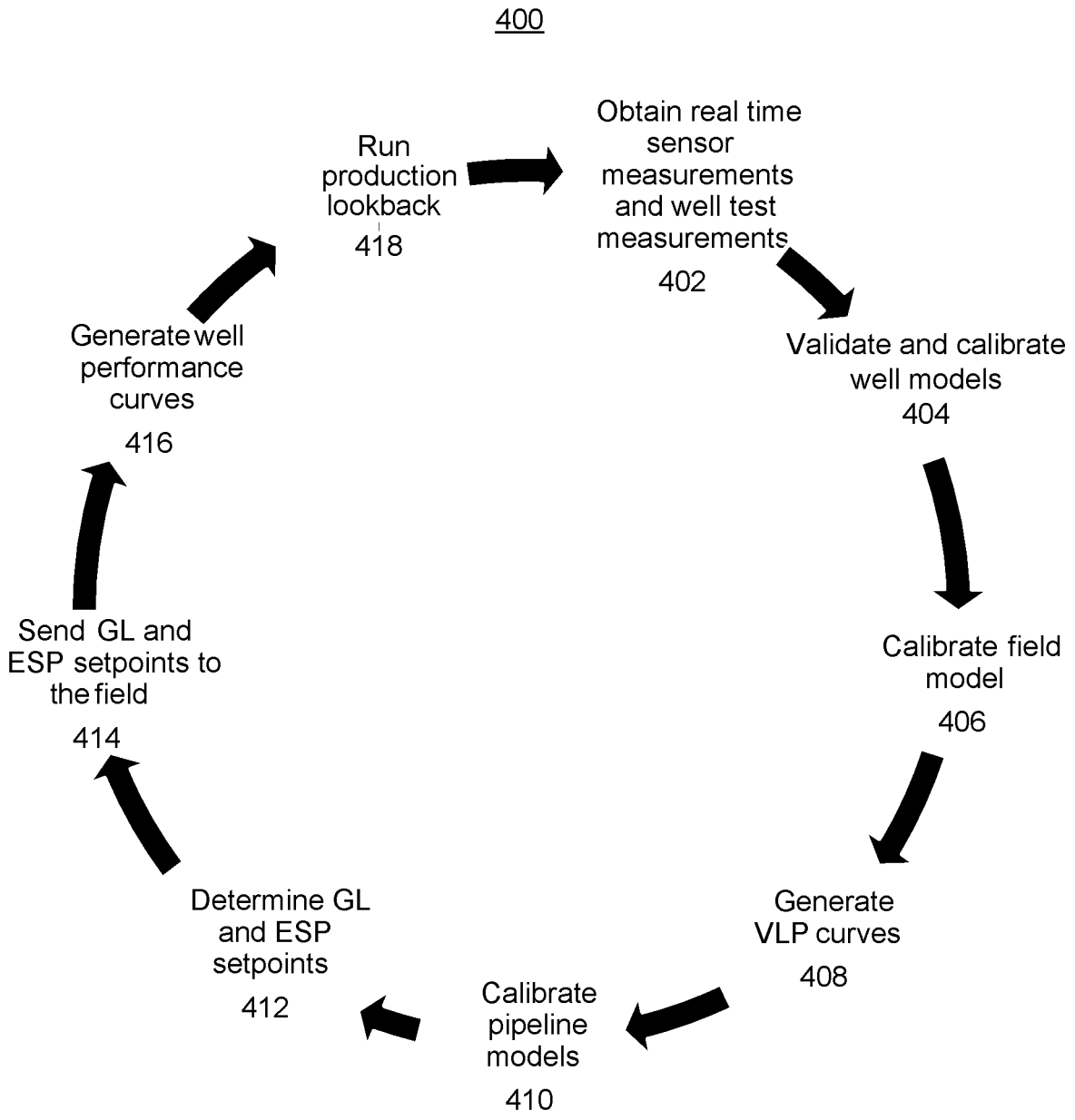
FIG. 4 illustrates an example flow diagram for controlling operation of multiple wells.

FIG. 4 illustrates an example flow diagram 400 for controlling operation of multiple wells in a field. At step 402, real time sensor measurements and well test measurements for the wells may be obtained. At step 404, well models for the well may be validated and calibrated based on the real time sensor measurements and/or the well test measurements for the wells. Validation may be performed based on the real time sensor measurements and/or the well test measurements for the wells to check whether the simulation results of the well models match the real time sensor measurements and/or the well test measurements for the wells. Calibration may be performed for the well models with simulation results different from the real time sensor measurements and/or the well test measurements for the wells. Calibration of the well models may enable the well models to forecast production performance of the wells, with the forecasting by the well models anchored onto real time sensor measurements and/or the well test measurements that represent actual performance of the wells. At step 406, a field model for the field (including the wells) may be calibrated. Calibration of the field model may include adjustments to the field model to match the conditions in the field (e.g., adjust the field model using pressure readings from the field and whether wells are flowing or not to ensure that well models add up to match the actual performance in the field). At step 408, Vertical Lift Performance (VLP) curves for the wells may be generated. VLP curves may be generated based on ranges set for VLP sensitivities. VLP curves may be generated to be used as proxy of the wells when modeling at the field level. At step 410, pipeline models for pipelines connecting wells and facilities in the field may be calibrated so that the pipeline models matches conditions in the field. At step 412, gas lift (GL) setpoints (e.g., gas lift gas rate) and/or electrical submersible pump (ESP) setpoints (e.g., ESP frequency) may be determined using the calibrated field model, which includes/incorporates the calibrated well models and the calibrated pipeline models. The GL setpoints and/or ESP setpoints may be optimized using the calibrated field model. At step 414, the GL setpoints and/or ESP setpoints may be sent to the field for use in the field. The wells may be automatically controlled to use the GL setpoints and/or ESP setpoints. At step 416, well performance curves for the wells in the field may be generated. At step 418, production lookback may be run. The flow diagram 400 may return to step 402, where new/more recent real time sensor measurements and well test measurements for the wells may be obtained, and the process repeats.

Referring back to FIG. 1, the processor 11 may be configured to provide information processing capabilities in the system 10. As such, the processor 11 may comprise one or more of a digital processor, an analog processor, a digital circuit designed to process information, a central processing unit, a graphics processing unit, a microcontroller, an analog circuit designed to process information, a state machine, and/or other mechanisms for electronically processing information. The processor 11 may be configured to execute one or more machine-readable instructions 100 to facilitate controlling operation of multiple wells. The machine-readable instructions 100 may include one or more computer program components. The machine-readable instructions 100 may include a well model component 102, a field model component 104, a field measurement component 106, a well model calibration component 108, a field model calibration component 110, an operation parameter component 112, an operation component 114, and/or other computer program components.

The well model component 102 may be configured to obtain well model information and/or other information.

Obtaining well model information may include one or more of accessing, acquiring, analyzing, determining, developing, examining, generating, identifying, loading, locating, opening, preparing, receiving, retrieving, reviewing, selecting, storing, and/or otherwise obtaining the well model information. The well model component 102 may obtain well model information from one or more locations. For example, the well model component 102 may obtain well model information from a storage location, such as the electronic storage 13, electronic storage of a device accessible via a network, and/or other locations. The well model component 102 may obtain well model information from one or more hardware components (e.g., a computing device) and/or one or more software components (e.g., software running on a computing device).

The well model information may define well models for multiple wells in a field. The well model information may define a well model for individual wells in the field. A well may refer to a hole that is drilled in the ground. A well may be drilled in the ground for exploration and/or recovery of resources in the ground, such as water or hydrocarbons. For example, a well may be drilled for production of hydrocarbons (e.g., as a production well, as an injection well). A field may refer to a region that stores hydrocarbons and/or other mineral resources in the ground. A field may refer to a surface area above a subsurface hydrocarbon and/or other mineral accumulation. For example, a field may include a reservoir in which hydrocarbons and/or other mineral resources are trapped.

A field may include wells, facilities, such as storage, processing, and/or transport facilities, pipeline connecting wells and/or facilities in the field, and/or other components. The wells in the field may include one or more artificially lifted wells. An artificially lifted well may refer to a well in which one or more artificial lift processes is being used. An artificially lifted well may refer to a well in which the liquid flow (e.g., oil, water) is increased using one or more artificial means. For example, an artificially lifted well may include a gas lift well or an electrical submersible pump well (ESP well). One or more artificially lifted wells may be deployed in an unconventional reservoir. An unconventional reservoir may refer to a reservoir where hydrocarbons and/or other resources (e.g., oil, gas) are tightly bound to the rock fabric by strong capillary forces. Specialized measures, such as the use of artificially lifted wells, may be required for evaluation and extraction of the resources from unconventional reservoirs. Other types of wells are contemplated.

A well model may refer to a computer model (e.g., program, tool, script, function, process, algorithm) that simulates components, properties, and/or behaviors of a well. A well model may represent and simulate different components of the well. A well model may enable simulation of well operations that takes into account different components of the well, how those components are operated, fluid dynamics in and around the well, and/or other information relating to the well.

A well model may be run to simulate components, properties, and/or behaviors of a well under different conditions (e.g., different conditions around and/or inside the well, different conditions in which well components are operated). A well model may utilize/incorporate physics of well behavior to predict how a well may respond to different conditions. For example, a well model may be used to predict production from the well for different operating conditions of the well (e.g., based on different GL setpoints and/or ESP setpoints). A well model for a well may be designed (e.g., parameters of the well model may be set) so that the simulation results of the well model matches historical data (e.g., historical sensor measurements, well test measurement) of the well. For example, a well model for a well may be developed using history matching. Model parameters of the well model may be varied until the simulation results of the well model matches the historical data (e.g., production simulated by the well model matches historical production data). Multiple well models may be developed for a well and the well model with simulation results that best matches the historical data of the well may be selected as the well model for the well.

A well model may be used in a nodal analysis to estimate production from well under different conditions. A well model may be used in a nodal analysis to determine the performance of the well under different conditions. A well model may be used in a nodal analysis to model the inflow performance of fluid (e.g., reservoir fluid) into the well and the outflow performance of fluid through the tubing of the well.

The well model information may define a well model for a well by including information that defines one or more content, qualities, attributes, features, and/or other aspects of the well model for the well. For example, the well model information may define a well model for a well by including information that makes up the physics of the well behavior/well component behavior and/or information that is used to determine the physics of the well behavior/well component behavior. Other types of well model information are contemplated.

The field model component 104 may be configured to obtain field model information and/or other information. Obtaining field model information may include one or more of accessing, acquiring, analyzing, determining, developing, examining, generating, identifying, loading, locating, opening, preparing, receiving, retrieving, reviewing, selecting, storing, and/or otherwise obtaining the field model information. The field model component 104 may obtain field model information from one or more locations. For example, the field model component 104 may obtain field model information from a storage location, such as the electronic storage 13, electronic storage of a device accessible via a network, and/or other locations. The field model component 104 may obtain field model information from one or more hardware components (e.g., a computing device) and/or one or more software components (e.g., software running on a computing device).

The field model information may define a field model for the field. A field model may refer to a computer model (e.g., program, tool, script, function, process, algorithm) that simulates components, properties, and/or behaviors of a field. A field model may represent and simulate different components in the field. For example, a field model may simulate wells in the field, facilities (e.g., central tank batteries, separators) in the field, connections (e.g., pipelines, production headers) between the wells and the facilities in the field, and/or other components in the field. A field model may enable simulations of field operations that takes into account different components in the field, how those components are operated, fluid dynamics in the field, and/or other information relating to the field. A field model may include models for components in the field (e.g., well models, facility models, connection models) and/or incorporate models for the components in the field through proxies (e.g., proxies for well models, facility models, connection models).

A field model may be run to simulate components, properties, and/or behaviors of a field under different conditions (e.g., different conditions in the field, different conditions in which field components are operated). A field model may utilize/incorporate physics of field behavior (e.g., well behavior, facility behavior, connection behavior) to predict a field and/or different components in the field may respond to different conditions. For example, a well model may be used to predict production from the wells in the field for different operating conditions of the wells (e.g., based on different GL setpoints and/or ESP setpoints), while taking into account capabilities and/or constraints of central tank batteries in the field and connections (e.g., pipelines, production headers) between different components in the field. A field model for a field may be designed (e.g., parameters of the field model may be set) so that the simulation results of the field model matches historical data (e.g., historical sensor measurements, well test measurement) of the field. For example, a field model for a field may be developed using history matching.

A field model may be used in a nodal analysis to estimate production from wells in the field under different conditions. A field model may be used in a nodal analysis to determine the performance of the wells and/or other components in the field under different conditions.

The field model information may define a field model for a field by including information that defines one or more content, qualities, attributes, features, and/or other aspects of the field model for the field. For example, the field model information may define a field model for a field by including information that makes up the physics of the field behavior/field component behavior and/or information that is used to determine the physics of the field behavior/field component behavior. Other types of field model information are contemplated.

The field measurement component 106 may be configured to obtain field measurement information and/or other information. Obtaining field measurement information may include one or more of accessing, acquiring, analyzing, determining, examining, generating, identifying, loading, locating, measuring, opening, receiving, retrieving, reviewing, selecting, storing, and/or otherwise obtaining the field measurement information. The field measurement component 106 may obtain field measurement information from one or more locations. For example, the field measurement component 106 may obtain field measurement information from a storage location, such as the electronic storage 13, electronic storage of a device accessible via a network, and/or other locations. The field measurement component 106 may obtain field measurement information from one or more hardware components (e.g., a computing device, a sensor, a component of a field) and/or one or more software components (e.g., software running on a computing device). For example, the system 10 may include one or more of a pressure sensor, fluid flowrate sensor, temperature, and/or other sensors, and the field measurement component 106 may obtain field measurement information by using the sensor(s) to determine/measure operating characteristics of multiple wells in the field. Use of other sensors is contemplated.

The field measurement information may define operation characteristics of the multiple wells in the field. Operation characteristics of a well may refer to characteristics of the well during operation (e.g., for production). Operation characteristics of a well may refer to attribute, quality, configuration, parameter, and/or characteristics of matter inside, within, and/or around the well during operation. Operation characteristics of a well may refer to characteristics of the well, characteristics of one or more components of the well, characteristics of conditions around the well, characteristics of conditions inside the well, and/or other characteristics of the during operation. Operation characteristic of a well may include static characteristics (e.g., design of the well) and/or dynamic characteristics (e.g., properties of materials/fluids inside or around the well, operation parameters of the well). For example, operation characteristics of a well, which may change over time, may include pressure (e.g., casing head pressure, pump intake pressure, wellhead pressure, flowline pressure, bottom hole pressure, production header pressure, separator pressure, reservoir pressure), pressure difference (e.g., choke pressure drop), gas/oil ratio (GOR), gas lift gas rate, fluid flow rate (e.g., gas flow rate, liquid flow rate, water flow rate, oil flow rate), ESP frequency, water cut, well flowing status, temperature, cumulative production to date, and/or other operation characteristics of the well. Use of other operation characteristics of a well are contemplated.

In some implementations, the field measurement information may include real time sensor measurements, well test measurements, and/or other measurements. Real time sensor measurements may refer to measurements that indicate current measurements of the operation characteristics provided by one or more sensors. Real time sensor measurements may be obtained to determine current condition in which the well is operating. Well test measurements may refer to measurements that indicate operation characteristics measured during well tests. Well test measurements may be performed less frequently than real time sensor measurements. For example, well test measurements may be performed once a month while real time sensor measurements may be performed in an on-going manner. Other frequency of well test measurements and real time sensor measurements is contemplated.

Real time sensor measurements and well test measurements may be performed for same type of operation characteristics. Values of a particular operation characteristic may be measured in both the real time sensor measurements and the well test measurement. Real time sensor measurements and well test measurements may be performed for different types of operation characteristics. Values of a particular operation characteristic may be measured in the real time sensor measurements but not in the well test measurement, or vice versa.

The field measurement information may define operation characteristics of the multiple wells in the field by including information that characterizes, describes, delineates, identifies, is associated with, quantifies, reflects, sets forth, and/or otherwise defines one or more of value, property, quality, quantity, attribute, feature, and/or other aspects of the operation characteristics of the multiple wells in the field. The field measurement information may directly and/or indirectly define operation characteristics of the multiple wells in the field. For example, the field measurement information may define operation characteristics of a well by including information that specifies the type and/or value of the operation characteristics of the well and/or information that may be used to determine the type and/or value of the operation characteristics of the well. Other types of field measurement information are contemplated.

The well model calibration component 108 may be configured to calibrate the well models for the multiple wells in the field. Calibrating a well model may include setting, adjusting, modifying, and/or otherwise calibrating the well model. For example, calibrating a well model may include changing values of model parameters for the well model and/or changing which model parameters are used for the well model. Calibration of a well model include gas separation efficiency and wear factor calibration, vertical lift performance (VLP) calibration, inflow performance relationship (IPR) calibration, and/or other calibration of the well model. Same types of calibration may be performed for different types of wells. Different types of calibration may be performed for different types of wells. For example, gas separation efficiency and wear factor calibration may be performed for ESP wells, and VLP calibration and IPR calibration may be performed for gas lift wells. Other calibration of the well models is contemplated.

The well models for the multiple wells in the field may be calibrated based on the field measurement information and/or other information. Simulation results of a well model may be compared to field measurement information to determine whether the well model is accurately simulating conditions at the well. Responsive to the simulation results of the well model accurately simulating conditions at the well (e.g., simulation results are different from the field measurement information, difference between the simulation results and the field measurement information is more than a threshold amount), the well model may be calibrated. Model parameters and/or values of model parameters of the well model may be changed until the results of the well model matches the field measurement information (e.g., simulation results are same as the field measurement information, difference between the simulation results and the field measurement information are less than a threshold amount).

In some implementations, calibration of a well model for an ESP well in the field based on the field measurement information may include determination of an ESP pump's gas separation efficiency and wear factor (friction factor) for the well model (gas separation efficiency and wear factor calibration). Comparison between pump intake pressure simulated by the well model (e.g., pump intake pressure estimated by the well model using a gradient calculation) and measured pump intake pressure of the ESP well may be used to determine whether the well model for the ESP well needs to be calibrated. If the simulated pump intake pressure and the measured pump intake pressure match (e.g., simulated pump intake pressure is same as or within a threshold amount of the measured pump intake pressure), calibration of the well model for the ESP well may not be performed. If the simulated pump intake pressure and the measured pump intake pressure do not match (e.g., simulated pump intake pressure is different from the measured pump intake pressure, difference between the simulated pump intake pressure and the measured pump intake pressure) is more than a threshold amount, calibration of the well model for the ESP well may be performed.

For calibration, gas separation efficiency of the ESP well may be determined by computation and combination of gas separation efficiency parameters (e1 and e2). Gas separation efficiency parameter e1 may be computed by using a choke equation to estimate the amount of gas vented through an outflow portion into an annulus. The gas separation efficiency parameter e1 may be computed as the ratio of the estimated gas to the free gas going into the pump (e.g., computed using pressure-volume-temperature properties). The gas separation efficiency parameter e1 may be computed using one or more mechanistic model for the ESP well. The gas separation efficiency (e) of the ESP well may be computed as the difference between (1) the combination of gas separation efficiency parameter e1 and gas separation efficiency parameter e2, and (2) the product of gas separation efficiency parameter e1 and gas separation efficiency parameter e2:

$$e = (e1 + e2) - (e1 * e2)$$

Such computation of the gas separation efficiency may result in more accurate initial starting point for the well model than use of either gas separation efficiency parameters e1, e2. Pump intake pressure of the well model may be estimated (e.g., using a gradient calculation) by using the gas separation efficiency (e). For the estimation of the pump intake pressure, the wear factor may be set to zero (assume no wear factor). The newly estimated pump intake pressure (simulated pump intake pressure) may be compared to the measured pump intake pressure. If the estimated pump intake pressure with no wear factor is higher than the measured pump intake pressure, the gas separation efficiency may be increased until the estimated pump intake pressure is lower than the measured pump intake pressure. If the estimated pump intake pressure with maximum gas separate efficiency is still higher than the measured pump intake pressure, modeling of the pump or motor in the well may be incorrect and the user may be notified of potential error in the well model (e.g., pump or motor specification provided for the well model is not correct). With the computed gas separation efficiency from the above, a gradient calculation with pump intake pressure and wellhead pressure as boundary condition may be used to determine the wear factor for the well model. Historical information for the well may be used to determine the wear factor for the well model. For example, if the well has been experiencing decreasing as separation (gas separation efficiency has been decreasing), then the value of the wear factor may be determined so that the estimated pump intake pressure is same as the measured pump intake pressure.

In some implementations, calibration of a well model for a well (e.g., gas lift well) in the field based on the field measurement information may include determination of a vertical lift performance correlation for the well model (VLP calibration). The vertical lift performance correlation may determine how pressure drop in the tubing of the well is computed. The vertical lift performance correlation may be used to determine the flow regime (e.g., bubble flow, mist flow, etc.) within the tubing, and the flow regime within the tubing may be used to determine the pressure drop in the tubing.

The vertical lift performance correlation for the well may be determined based on comparison between pressure drop in a tubing simulated by the well model and measured tubing pressure drop of the well and/or other information. The vertical lift performance correlation for the well may be selected using step rate well tests for wells with similar pressure-volume-temperature. For a naturally flowing well with a downhole gauge, a gradient calculation may be iteratively run while adjusting the VLP friction and gravity factors. The VLP friction and gravity factors may be adjusted until the pressure drop in the well (in the tubing of the well) estimated using the well model matches the measured pressure drop (from the wellhead to the downhole gauge). For a gas lift well with a downhole gauge, both a gradient pressure calculation down the tubing with wellhead pressure and liquid rate as input and a gradient pressure calculation down the annulus with the casing head pressure and gas lift gas rate as input may be run. The gas injection depth (gas injection location) of the gas lift well may be estimated to be located at the point where the gradient calculated tubing pressure matches the gradient calculated annular pressure minus the pressure drop across the injection valve, while adjusting the VLP friction/gravity factor to match the measured down hole gauge pressure. Historical information for the well may be used to determine the gas injection depth of the gas lift well. For example, historical gas injection depths of the gas lift well may be used to determine current gas injection depth, while taking into account increased buildup of friction along the tubing. If a match does not exist between the gradient calculated tubing pressure and the gradient calculated annular pressure, multipoint injection may be tested by splitting gas injection across multiple valves. If a match does not exist between the gradient calculated tubing pressure and the gradient calculated annular pressure, modeling of the tubing in the well may be incorrect and the user may be notified of potential error in the well model (e.g., tubing specification provided for the well model is not correct).

In some implementations, calibration of a well model for a well in the field based on the field measurement information may include adjustment of reservoir pressure and productivity index for the well model (IPR calibration). IPR calibration may be performed after the VLP calibration. IPR calibration may include adjustment of the reservoir pressure and the productivity index (IPR adjustment) so that estimated (simulated) production rate (e.g., intersection between the VLP curve and the IPR curve) matches the measured production rate (e.g., simulated production rate is same as or within a threshold amount of the measured production rate). For a gas lift well or a naturally flowing well with a downhole gauge, flowing bottom hole pressure may be determined using a gradient pressure calculation from gauge depth to reservoir reference depth. For a gas lift well and naturally flowing well without a downhole gauge, flowing bottom hole pressure may be determined using gradient pressure calculation from wellhead to reservoir reference depth. Shut-in bottom hole pressure may be determined based on pressure buildup from a prior well shut-in (e.g., last 24-hour well shut-in), such as by using a gradient pressure calculation from gauge depth.

Uncertainty in the calibration may be reduced by using the flowing bottom hole pressure and the shut-in bottom hole pressure as the lower and upper boundary for the well flowing bottom-hole pressure intercept (Pr). The well flowing bottom-hole pressure intercept and the productivity index (PI) of the IPR curve may be adjusted based on the well's production profile and/or other information. The well flowing bottom-hole pressure intercept and the productivity index (PI) of the IPR curve may be iteratively adjusted until the estimated production rate matches the measured production rate of the well.

The reservoir pressure and the productivity index for the well model may be adjusted based on one or more measured operating points of the well, comparison between one or more operating points simulated by the well model and one or more measured operating points of the well, and/or other information. An operating point of a well may refer to a particular value of an operation characteristic of the well, such as liquid rate, GOR, cumulative production to date, etc. Use of other types of operating points is contemplated.

In some implementations, one or more inflow performance relationship calibration rules may define extent of reservoir pressure and productivity index adjustment based on one or more measured operating points of the well and/or other information. An IPR calibration rule may determine how the reservoir pressure and the productivity may be adjusted (e.g., increased, decreased, amount of change) based on the measured operating point(s) of the well. For example, an IPR calibration rule may specify the amount and/or direction by which reservoir pressure and/or productivity index should be changed based on the value of the measured operating point (e.g., increase reservoir pressure by X % and increase productivity index by Y % if the measured operating point within a certain range, is less than a certain value, is greater than a certain value).

An IPR calibration rule may determine how the reservoir pressure and the productivity may be adjusted based on comparison(s) between the simulated operating point(s) and the measured operating point(s). For, example, an IPR calibration rule may specify the amount and/or direction by which reservoir pressure and/or productivity index should be changed based on the difference between the simulated operating point(s) and the measured operating point(s) (e.g., increase reservoir pressure by X % of the difference between simulated operating point and measured operating point, increase productivity index by Y % of the difference between simulated operating point and measured operating point). An IPR calibration rule may specify one or more limits (e.g., maximum value, minimum value) on the value of the reservoir pressure and/or the value of the productivity index such that the reservoir pressure and/or the productivity index do not exceed (rise above, fall below) the limit(s). An IPR calibration rule may specify one or more limits on the change in the value of the reservoir pressure and/or the change in the value of the productivity index such that the value by which the reservoir pressure and/or productivity index are adjusted do not exceed (rise above, fall below) the limit(s). An IPR calibration rule may specify one or more conditions that must be met for the reservoir pressure and/or the productivity to be adjusted. Other types of IPR calibration rules are contemplated.

Use of other information and/or processes for validation and calibration of well models is contemplated. For example, gas separation efficiency and wear factor calibration, VLP calibration, and/or IPR calibration may be performed using additional/alternative information and/or additional/alternative steps.

Calibrated well models may be used to generate VLP curves for the wells. VLP curves may be generated to be used as proxy of the wells when modeling at the field level. VLP curves generated for the wells may be included/incorporated in the field model for the field. Inputs to the VLP curve generation may include (1) VLP generation range, such as min/max range multiplier per VLP input and number of VLP sensitivity points to be generated per VLP Input, and (2) VLP generation option, such as whether VLP curves will be generated for all wells, selected wells, or wells that are operating outside of the VLP sensitivity variable range(s). VLP curves may be generated from field measurements (e.g., well test measurements, real time sensor measurement) and by simulating well performance using the calibrated well models. Field measurements and simulations may be used to determine min and max of well operation characteristics, such as liquid rate, wellhead pressure, gas/oil ratio, water cut, casing head pressure, gas lift gas rate, and ESP frequency value. The min/max values may be multiplied by the min/max range multipliers. Gas lift min and max range multipliers may be used as actual min and maximum values.

The field model calibration component 110 may be configured to calibrate the field model for the field. Calibrating a field model may include setting, adjusting, modifying, and/or otherwise calibrating the field model. For example, calibrating a field model may include changing values of model parameters for the field model and/or changing which model parameters are used for the field model. Calibration of a field model may include adjusting model parameter to match conditions at the field. Calibration of a field model may include pipeline calibration. Other calibration of the field model is contemplated.

The field model for the field may be calibrated based on the field measurement information and/or other information. Calibrating the field model based on the field measurement may include turning on/activating or turning off/deactivating well models based on whether the corresponding wells in the field are on or off, updating pressures/boundaries conditions at central tank batteries to match conditions in the field, and/or other wise setting up the field model to represent conditions in the field. For example, the field model may be calibrated to match pressures readings taken in the field at wellheads, choke lines, flowlines, central tank batteries, and/or other locations. Pipeline calibration may include adjustment of pipeline friction coefficient for the field model to match pressure drop in the field. For example, pipeline friction coefficient for the field may be calibrated using real time pressure drop in the pipe. Pipeline friction coefficient may be adjusted so that fluid flow simulated through the pipelines match the fluid flow through the pipelines in the field. The field model may be calibrated so that pressure drop in the pipelines simulated by the field model matches the pressure drop in the pipelines in the field.

The operation parameter component 112 may be configured to determine values of operation parameters for the multiple wells in the field. Determining values of operation parameters for wells may include ascertaining, approximating, calculating, establishing, estimating, finding, identifying, obtaining, quantifying, selecting, setting, and/or otherwise determining the values of operation parameters for the wells. Operation parameters for a well may refer to parameters (e.g., factors, characteristics, settings) that controls, affects, and/or otherwise determines how the well is operated (e.g., for production). Operation parameters for a well may refer to parameters that controls, affects, and/or otherwise determines how components of the well and/or components in the field connected to the well are operated. Operation parameters for a well may include one or more artificial lift parameters for the well. An artificial lift parameters for a well may refer to a parameter for controlling, affecting, and/or otherwise determining how an artificial process is used, how an artificially lifted well is operated, and/or how components of an artificially lifted well are operated. For example, operation parameters for wells in the field may include gas lift gas rate for gas lift wells, electrical submersible pump frequency for electrical submersible pump wells, and/or other operation parameters for other wells. Gas lift gas rate may refer to a rate at which is gas is injected into the production tubing of a gas lift well to reduce the hydrostatic pressure of the fluid column. Electrical submersible pump frequency may refer to the frequency at which the pump/motor of an ESP well is operated. As another example, operation parameters for wells in the field may include choke settings, discharge pressure (compression), and/or other operation parameters for the wells. Other operation parameters are contemplated.

The values of operation parameters for the wells in the field may be determined based on the calibrated well models, the calibrated field model, and/or other information. The calibrated models (calibrated well models and/or calibrated field models) and/or the outputs of the calibrated models (simulation results from the calibrated models, VLP curves, IPR curves) may be used to determine values of operation parameters for the wells in the field.

In some implementations, determination of the values of the operation parameters for the multiple wells in the field based on the calibrated well models and the calibrated field model may include determination of values of gas lift gas rate for gas lift wells and/or values of electrical submersible pump frequency for electrical submersible pump wells that increase production from the field while adhering to constraints at individual wells, individual production headers, individual central tank batteries, and/or other components in the field. For example, gas lift gas rates and/or electrical submersible pump frequency may be determined to improve production (increase production, maximize production, increase efficiency of production, optimize production) in the field while respecting operational constraints of the wells, production headers, central tank batteries, and/or constraints in the field.

A constraint in the field may refer to a limitation or a restriction on usage of the field for production. For example, constraints in the field may include fluid (e.g., oil, water, gas) capacity in the field, tank levels in the field, power consumption limitations in the field, and/or pressure in the field. A constraint in the field may include a constraint at a component in the field. A constraint at a component in the field may refer to a limitation or a restriction on how the component may be operated (e.g., operational constraint). For example, multiple wells may be connected to a production header and multiple production headers may be connected to a central tank battery. A production header may have a constraint on how much gas is available at the production header for gas injection in the wells connected to the production header (e.g., available gas injection per production header) while a central tank battery may have a constraint on how much gas is available at the central tank battery for gas injection through the production headers connected to the central tank battery (e.g., available gas injection per central tank battery). As another example, constraints may come from the component being used, such as the ESP motor being used at an ESP well. Other types of constraints are contemplated.

In some implementations, determination of the values of the operation parameters for the multiple wells in the field based on the calibrated well models and the calibrated field model may include determination a performance curve tree for the field. A performance curve tree may refer to a grouping of performance curves for components in the field, with the performance curves arranged in a hierarchy based on the arrangements of the components in the field. The values of the operation parameters for the multiple wells in the field may be determined based on the performance curve tree for the field.

Figure 5:
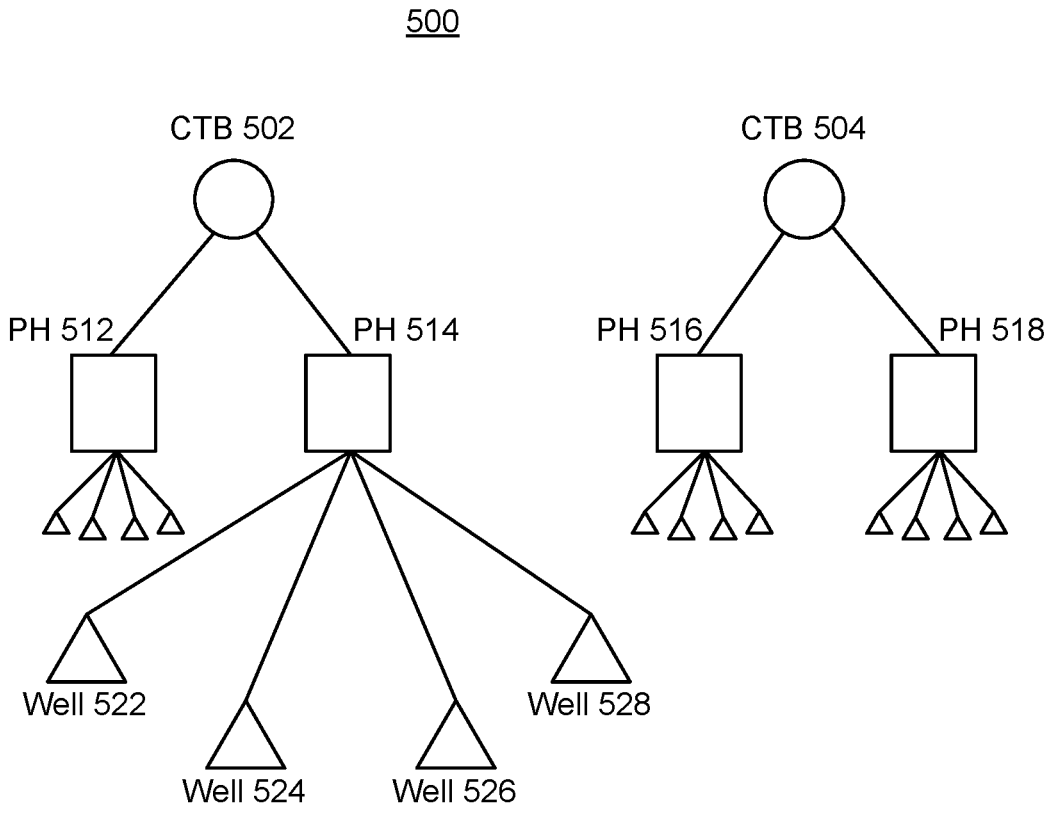
FIG. 5 illustrates an example representation of central tank batteries, production headers, and wells in a field.

For example, a field may include multiple wells with fluid flowing into a production header through their individual flowlines. Fluid from multiple wells may flow into a shared trunkline before flowing into a production header. Fluid from one or more production headers may flow into a central tank battery. FIG. 5 illustrates an example representation 500 of central tank batteries, production headers, and wells in a field. In FIG. 5, a field may include two central tank batteries 502, 504, represented by circles. Individual central tank batteries may be connected to two production headers, 512 and 514, 516 and 518, represented by squares. Individual production headers may be connected to four wells, represented by squares. The production header 514 is shown as being connected to 522, 524, 526, 528. The number of central tank batteries, production headers, and wells shown in FIG. 5 are merely provided as examples and is not meant to be limiting. Other numbers and arrangements of field components are contemplated.

The performance curve tree for the field may include performance curves for individual wells, performance curves for individual production headers, performance curves for individual central tank batteries, and/or performance curves for other components in the field. The performance curve tree for the field may include an overall field performance curve at the top, the performance curves for the central tank batteries below the overall field performance curve, the performance curves for the production headers below the performance curves for the corresponding central tank batteries, and the performance curves for the wells below the performance curves for the corresponding production headers.

A performance curve for a well may include a gas lift performance curve for the well. The gas lift performance curve for the well may indicate response of the well to increase in gas lift (increased lift gas volumes). The gas lift performance curve for the well may define values of liquid rate (production rate) of the well as a function of gas lift gas rate for the well.

A performance curve for a well may be determined by taking into account backpressure from the flowlines of the well. A performance curve for a well may be determined based on isolation of a well model corresponding to the well in the field model and calculation of liquid rate at different gas lift gas rates. The well model may be isolated to test performance of the well at different gas lift gas rates. The liquid rate of the well may be calculated for gas lift gas rates ranging from a minimum value (e.g., zero) to a maximum value (e.g., the well's gas lift gas rate maximum constraint). A performance curves (GL performance curve) may be determined for individual wells in the field.

A performance curve for a production header may include a gas lift performance curve for the production header. The gas lift performance curve for the production header may indicate response of the production header to increase in gas lift. The gas lift performance curve for the production header may indicate response (optimal response) of the wells connected to the production header to increase in gas lift. The gas lift performance curve for the production header may define values of liquid rate (production rate) of the wells connected to the production header as a function of gas lift gas rate for the production header.

A performance curve for a production header may be determined based on incremental distribution of gas lift gas rates among wells connected to the production header. A performance curve for a production header may be determined by computing the minimum gas lift gas rate and the maximum gas lift gas rate for the production header. The minimum gas lift gas rate for a production header may refer to the sum of minimum gas lift gas rate needed to keep all wells connected to the production header flowing. The maximum gas lift gas rate for a production header may refer to the maximum gas lift gas rate constraint for the production header.

For values of gas lift gas rate (GLGR_ph_current) between the minimum and the maximum gas lift gas rate for a production header, distribution of the gas lift gas values among wells connected to the production header may be determined to increase production. For example, from the minimum gas lift gas rate, the gas lift gas rate (GLGR_ph_current) may be incremented by a certain amount (e.g., 50 mscfd), and the optimal distribution of the gas lift gas rate among the wells connected to the production header may be determined to maximize production for each value of gas lift gas rate (GLGR_ph_current).

Which of the wells connected to the production header will receive the incremental increase in the gas lift gas rate of the production header may be determined by using the gas lift performance curve of wells to see which of the wells will provide most production for the incremental increase in the gas lift gas rate. Allocation of the incremental increase in the gas lift rate to a well may provide a liquid rate-gas lift gas rate point to be added to the performance curve for the production header. The production rate increase provided by the most productive well for the incremental increase in the gas lift gas rate may determine how much the performance curve for the production header will increase for the given incremental increase in the gas lift gas rate. Different values of the performance curve (different parts of the performance curve) for the production header may be associated with allocation of the incremental increase in the gas lift gas rate to a particular well.

For each gas lift gas rate (GLGR_ph_current) between the production header's minimum gas lift gas rate and the production header's maximum gas lift gas rate, the gas lift gas rate that yields increased (e.g., maximum) production for each well may be determined using the gas lift performance curve of the wells and then these gas lift gas rates and oil production may be summed across the production header to yield operating gas lift gas rate (GLGR_ph_o) and oil production for the production header. The operating gas lift gas rate may include preferred or optimal gas lift gas rate. To do this, the oil rate to the GLGR derivative along all the wells' gas lift performance curves may be computed. These derivatives may be used to allocate gas lift gas rate to wells that will contribute the most production for the least gas lift gas. This is done by first finding the GLGR yielding the maximum production for each well using its gas lift performance curve then iteratively decreasing the GLGR allocation to the wells based on the smallest oil rate to GLGR derivative until the GLGR allocated across all wells is less than the current gas lift gas rate for the production header (GLGR_ph_current).

A performance curve for a central tank battery may include a gas lift performance curve for the central tank battery. The gas lift performance curve for the central tank battery may indicate response of the central tank battery to increase in gas lift. The gas lift performance curve for the central tank battery may indicate response (optimal response) of the wells connected to the central tank battery through the production headers to increase in gas lift. The gas lift performance curve for the central tank battery may define values of liquid rate (production rate) of the wells connected to the central tank battery through the production headers as a function of gas lift gas rate for the central tank battery.

A performance curve for a central tank battery may be determined based on incremental distribution of gas lift gas rates among production headers connected to the central tank battery. A performance curve for a central tank battery may be determined by computing the minimum gas lift gas rate and the maximum gas lift gas rate for the central tank battery. The minimum gas lift gas rate for a central tank battery may refer to the sum of the minimum gas lift gas rate for production headers connected to the central tank battery or the minimum gas lift gas rate constraint for the central tank battery. The maximum gas lift gas rate for a central tank battery may refer to the sum of the maximum gas lift gas rate for production headers connected to the central tank battery or the maximum gas lift gas rate constraint for the central tank battery.

For values of gas lift gas rate (GLGR_ctb_current) between the minimum and the maximum gas lift gas rate for the central tank battery, distribution of the gas lift gas values among the production headers connected to the central tank battery may be determined to increase production. For example, from the minimum gas lift gas rate, the gas lift gas rate (GLGR_ctb_current) may be incremented by a certain amount (e.g., 50 mscfd), and the optimal distribution of the gas lift gas rate among the production headers connected to the central tank battery may be determined to maximize production for each value of gas lift gas rate (GLGR_ctb-_current).

Which of the production headers connected to the central tank battery will receive the incremental increase in the gas lift gas rate of the central tank battery may be determined by using the gas lift performance curve of production headers to see which of the production headers (wells connected to the production headers) will provide most production for the incremental increase in the gas lift gas rate. Allocation of the incremental increase in the gas lift rate to a production header may provide a liquid rate-gas lift gas rate point to be added to the performance curve for the central tank battery. The production rate increase provided by the most productive production header for the incremental increase in the gas lift gas rate may determine how much the performance curve for the central tank battery will increase for the given incremental increase in the gas lift gas rate. Different values of the performance curve (different parts of the performance curve) for the central tank battery may be associated with allocation of the incremental increase in the gas lift gas rate to a particular production header.

For each gas lift gas rate (GLGR_ctb_current) between the central tank battery's minimum gas lift gas rate and the central tank battery's maximum gas lift gas rate, the gas lift gas rate that yields increased (e.g., maximum) production for each production header may be determined using the gas lift performance curve of the production headers and then these gas lift gas rates and oil production may be summed across the central tank battery to yield operating gas lift gas rate (GLGR_ctb_o) and oil production for the central tank battery. To do this, the oil rate to the GLGR derivative along all the production headers' gas lift performance curves may be computed. These derivatives may be used to allocate gas lift gas rate to production headers that will contribute the most production for the least gas lift gas. This is done by first finding the GLGR yielding the maximum production for each production header using its gas lift performance curve then iteratively decreasing the GLGR allocation to the production headers based on the smallest oil rate to GLGR derivative until the GLGR allocated across all production headers is less than the current gas lift gas rate for the central tank battery (GLGR_ctb_current).

The performance curve tree for the field may include a gas lift performance curve tree for the field. An overall performance curve for the field (overall field performance curve) may be determined by using the performance curve tree for the field. The overall performance curve for the field may include overall gas lift performance curve for the field. The overall gas lift performance curve for the field may indicate response of the field to increase in gas lift. The overall gas lift performance curve for the field may indicate response (optimal response) of the wells in the field, which are connected to central tank batteries and production headers, to increase in gas lift. The overall gas lift performance curve for the field may define values of liquid rate (production rate) of the wells in the field as a function of gas lift gas rate for the field.

An overall performance curve for a field may be determined based on incremental distribution of gas lift gas rates among central tank batteries in the field. An overall performance curve for a field may be determined by computing the minimum gas lift gas rate and the maximum gas lift gas rate for the field. The minimum gas lift gas rate for a field may refer to the sum of the minimum gas lift gas rate for the central tank batteries in the field or the minimum gas lift gas rate constraints for the central tank batteries in the field. The maximum gas lift gas rate for a field may refer to the sum of the maximum gas lift gas rate for the central tank batteries in the field or the maximum gas lift gas rate constraints for the central tank batteries in the field.

For values of gas lift gas rate (GLGR_fld_current) between the minimum and the maximum gas lift gas rate for the field, distribution of the gas lift gas values among the central tank batteries in the field may be determined to increase production. For example, from the minimum gas lift gas rate, the gas lift gas rate (GLGR_fld_current) may be incremented by a certain amount (e.g., 50 mscfd), and the optimal distribution of the gas lift gas rate among the central tank batteries may be determined to maximize production for each value of gas lift gas rate (GLGR_fld_current).

Which of the central tank batteries in the field will receive the incremental increase in the gas lift gas rate of the field may be determined by using the gas lift performance curve of central tank battery to see which of the central tank batteries (wells connected to the central tank batteries through production headers) will provide most production for the incremental increase in the gas lift gas rate. Allocation of the incremental increase in the gas lift rate to a central tank battery may provide a liquid rate-gas lift gas rate point to be added to the overall performance curve for the field. The production rate increase provided by the most productive central tank battery for the incremental increase in the gas lift gas rate may determine how much the overall performance curve for the field will increase for the given incremental increase in the gas lift gas rate. Different values of the overall performance curve (different parts of the overall performance curve) for the field may be associated with allocation of the incremental increase in the gas lift gas rate to a particular central tank battery.

For each gas lift gas rate (GLGR_fld_current) between the field's minimum gas lift gas rate and the field's maximum gas lift gas rate, the gas lift gas rate that yields increased (e.g., maximum) production for each central tank battery may be determined using the gas lift performance curve of the central tank batteries and then these gas lift gas rates and oil production may be summed across the field to yield operating gas lift gas rate (GLGR_fld_o) and oil production for the field. To do this, the oil rate to the GLGR derivative along all the central tank batteries' gas lift performance curves may be computed. These derivatives may be used to allocate gas lift gas rate to central tank batteries that will contribute the most production for the least gas lift gas. This is done by first finding the GLGR yielding the maximum production for each central tank battery using its gas lift performance curve then iteratively decreasing the GLGR allocation to the central tank batteries based on the smallest oil rate to GLGR derivative until the GLGR allocated across all central tank batteries is less than the current gas lift gas rate for the field (GLGR_fld_current).

The performance curve tree for the field/overall performance curve for the field may map the field's available gas lift gas rate capacity to an improved (e.g., optimal) distribution of gas lift gas rate to different components in the field. For example, the performance curve tree for the field/overall performance curve for the field may map the field's available gas lift gas rate capacity to an optimal distribution of gas lift gas rate to all central tank batteries, an optimal distribution of gas lift gas rate to all production headers, and an optimal distribution of gas lift gas rate to all wells in the field. The gas lift gas rate available for the field may be allocated to central tank batteries, then to production headers connected to central tank batteries, and then to wells connected to production headers to improve (e.g., optimize) production from the field. The gas lift gas rate may be allocated to the wells while adhering to constraints at individual wells, individual production headers, individual central tank batteries, and/or other components in the field.

The values of the gas lift gas rate for the wells may be determined from the allocation of the gas lift gas rate. The values of ESP frequency for ESP wells may be determined while adhering to one or more constraints at individual wells (e.g., minimum and maximum ESP frequency, minimum and maximum pump rate, minimum and maximum variable frequency drive frequency, maximum gas in pump). Production from the field may be calculated using the values of the operation parameters for the wells (e.g., setpoints gas lift gas rate and/or electrical submersible pump frequency, choke settings, discharge pressure). Production from the field may include water production, gas production, liquid production, and/or other production from the field. If production from the field exceeds one or more constraints, one or more values of the operation parameters for the wells may be determined (e.g., calculated, modified, set).

For example, if water, gas, or liquid production from the field predicted using the setpoints for gas lift gas rate and/or electrical submersible pump frequency exceeds the total central tank battery water, gas, or liquid constraint, then the value of the ESP frequency may be decreased until the wells are running at the minimum ESP frequency needed to lift the liquid in the well (to prevent the well from dying). If the predicted production from the field still exceeds the constraint(s), one or more wells may be choked back. Wells may be choked back in order based on one or more factors. For example, choke-back of wells may start with wells with high gas/oil ratio if a gas production constraint is being violated or may start with wells with high water cut if water production constraint is being violated. With choke-back of wells being modeled, the production from the field (e.g., from the wells, production headers, central tank batteries) may be computed using nodal analysis to estimate how close the production is to the limiting constraints. The gas lift gas rates, ESP frequencies, and/or choke setting or the field that improve (e.g., maximize) production while adhering to all constraints in the field may be output for use in the field.

The operation parameters may be determined again (e.g., updated) based on changes in the field. For example, real time sensor measurements and well test measurements may be used to calibrate the models, and the performance curve tree for the field may be updated using calibrated models to update the values of the operation parameters for the wells.

The operation component 114 may be configured to facilitate automatic operations of the multiple wells in the field. Facilitating automatic operation of a well may include carrying out, controlling, initiating, performing, scheduling, setting up, and/or otherwise facilitating the automatic operation of the well. For example, facilitating automatic operation of a well may include setting and/or modifying one or more setpoints in how the well is operated. The automatic operations of the multiple wells in the field may be performed based on the determined values of the operation parameters and/or other information. For example, the setpoints (e.g., gas lift gas rate, ESP frequency, choke setting) for the wells in the field may be set/modified to the values determined by the operation parameter component 112 with little or no direct human control. The setpoints determined by the operation parameter component 112 may be automatically used to control how the wells in the field are operated. For example, the setpoints determined by the operation parameter component 112 may be sent to control devices in the field to automatically change how the wells are operated.

In some implementations, facilitation of the automatic operations of the multiple wells in the field based on the values of the operation parameters may include automatically changing values of the gas lift gas rate for the gas lift wells and/or values of the electrical submersible pump frequency for the electrical submersible pump wells. The values of the gas lift gas rate and the ESP frequency may be automatically changed to improve (e.g., maximize) production from the wells in the field. Choke settings of the wells may be automatically changed to control fluid flow in the wells. Other automatic operations of wells in the field are contemplated.

In some implementations, the determined values of the operation parameters and/or information determined from the operation parameter values may be provided and/or presented to one or more users in controlling the operation of the wells. For example, optimized setpoints for the wells may be communicated to an operator and/or presented on the electronic display 14. Other related information, such as the amount of production from the field (e.g., overall field production, production from components), amount of possible production from the field (e.g., using optimized setpoints), current operation parameters, operation parameters that could be used/suggested (e.g., optimized setpoints), model calibration status, and/or warnings about model calibration, may be communicated to an operator and/or presented on the electronic display 14.

Implementations of the disclosure may be made in hardware, firmware, software, or any suitable combination thereof. Aspects of the disclosure may be implemented as instructions stored on a machine-readable medium, which may be read and executed by one or more processors. A machine-readable medium may include any mechanism for storing or transmitting information in a form readable by a machine (e.g., a computing device). A machine-readable medium may include non-transitory computer-readable medium. For example, a tangible computer-readable storage medium may include read-only memory, random access memory, magnetic disk storage media, optical storage media, flash memory devices, and others, and a machine-readable transmission media may include forms of propagated signals, such as carrier waves, infrared signals, digital signals, and others. Firmware, software, routines, or instructions may be described herein in terms of specific exemplary aspects and implementations of the disclosure, and performing certain actions.

In some implementations, some or all of the functionalities attributed herein to the system 10 may be provided by external resources not included in the system 10. External resources may include hosts/sources of information, computing, and/or processing and/or other providers of information, computing, and/or processing outside of the system 10.

Although the processor 11, the electronic storage 13, and the electronic display 14 are shown to be connected to the interface 12 in FIG. 1, any communication medium may be used to facilitate interaction between any components of the system 10. One or more components of the system 10 may communicate with each other through hard-wired communication, wireless communication, or both. For example, one or more components of the system 10 may communicate with each other through a network. For example, the processor 11 may wirelessly communicate with the electronic storage 13. By way of non-limiting example, wireless communication may include one or more of radio communication, Bluetooth communication, Wi-Fi communication, cellular communication, infrared communication, or other wireless communication. Other types of communications are contemplated by the present disclosure.

Although the processor 11, the electronic storage 13, and the electronic display 14 are shown in FIG. 1 as single entities, this is for illustrative purposes only. One or more of the components of the system 10 may be contained within a single device or across multiple devices. For instance, the processor 11 may comprise a plurality of processing units. These processing units may be physically located within the same device, or the processor 11 may represent processing functionality of a plurality of devices operating in coordination. The processor 11 may be separate from and/or be part of one or more components of the system 10. The processor 11 may be configured to execute one or more components by software; hardware; firmware; some combination of software, hardware, and/or firmware; and/or other mechanisms for configuring processing capabilities on the processor 11. The system 10 may be implemented in a single computing device, across multiple computing devices, in a client-server environment, in a cloud environment, and/or in other devices/configuration of devices. The system 10 may be implemented using a computer, a desktop, a laptop, a phone, a tablet, a mobile device, a server, and/or other computing devices.

It should be appreciated that although computer program components are illustrated in FIG. 1 as being co-located within a single processing unit, one or more of computer program components may be located remotely from the other computer program components. While computer program components are described as performing or being configured to perform operations, computer program components may comprise instructions which may program processor 11 and/or system 10 to perform the operation.

While computer program components are described herein as being implemented via processor 11 through machine-readable instructions 100, this is merely for ease of reference and is not meant to be limiting. In some implementations, one or more functions of computer program components described herein may be implemented via hardware (e.g., dedicated chip, field-programmable gate array) rather than software. One or more functions of computer program components described herein may be software-implemented, hardware-implemented, or software and hardware-implemented.

The description of the functionality provided by the different computer program components described herein is for illustrative purposes, and is not intended to be limiting, as any of computer program components may provide more or less functionality than is described. For example, one or more of computer program components may be eliminated, and some or all of its functionality may be provided by other computer program components. As another example, processor 11 may be configured to execute one or more additional computer program components that may perform some or all of the functionality attributed to one or more of computer program components described herein.

The electronic storage media of the electronic storage 13 may be provided integrally (i.e., substantially non-removable) with one or more components of the system 10 and/or as removable storage that is connectable to one or more components of the system 10 via, for example, a port (e.g., a USB port, a Firewire port, etc.) or a drive (e.g., a disk drive, etc.). The electronic storage 13 may include one or more of optically readable storage media (e.g., optical disks, etc.), magnetically readable storage media (e.g., magnetic tape, magnetic hard drive, floppy drive, etc.), electrical charge-based storage media (e.g., EPROM, EEPROM, RAM, etc.), solid-state storage media (e.g., flash drive, etc.), and/or other electronically readable storage media. The electronic storage 13 may be a separate component within the system 10, or the electronic storage 13 may be provided integrally with one or more other components of the system 10 (e.g., the processor 11). Although the electronic storage 13 is shown in FIG. 1 as a single entity, this is for illustrative purposes only. In some implementations, the electronic storage 13 may comprise a plurality of storage units. These storage units may be physically located within the same device, or the electronic storage 13 may represent storage functionality of a plurality of devices operating in coordination.

Figure 2:
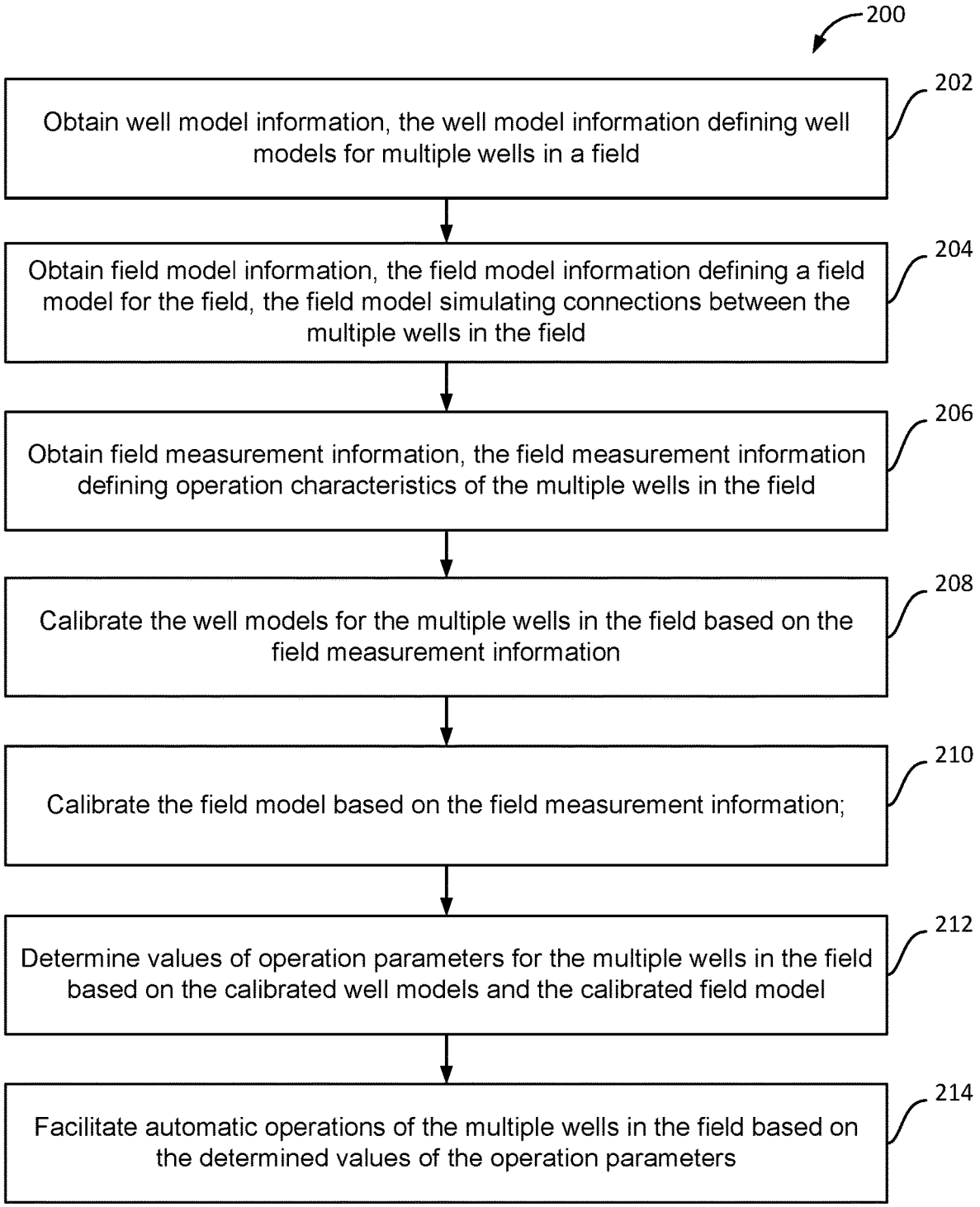
FIG. 2 illustrates an example method for controlling operation of multiple wells.

FIG. 2 illustrates an example method 200 for controlling operation of multiple wells. The operations of method 200 presented below are intended to be illustrative. In some implementations, method 200 may be accomplished with one or more additional operations not described, and/or without one or more of the operations discussed. In some implementations, two or more of the operations may occur substantially simultaneously.

In some implementations, method 200 may be implemented in one or more processing devices (e.g., a digital processor, an analog processor, a digital circuit designed to process information, a central processing unit, a graphics processing unit, a microcontroller, an analog circuit designed to process information, a state machine, and/or other mechanisms for electronically processing information). The one or more processing devices may include one or more devices executing some or all of the operations of method 200 in response to instructions stored electronically on one or more electronic storage media. The one or more processing devices may include one or more devices configured through hardware, firmware, and/or software to be specifically designed for execution of one or more of the operations of method 200.

Referring to FIG. 2 and method 200, at operation 202, well model information may be obtained. The well model information may define well models for multiple wells in a field. In some implementations, operation 202 may be performed by a processor component the same as or similar to the well model component 102 (Shown in FIG. 1 and described herein).

At operation 204, field model information may be obtained. The field model information may define a field model for the field. The field model may simulate connections between the multiple wells in the field. In some implementations, operation 204 may be performed by a processor component the same as or similar to the field model component 104 (Shown in FIG. 1 and described herein).

At operation 206, field measurement information may be obtained. The field measurement information may define operation characteristics of the multiple wells in the field. In some implementations, operation 206 may be performed by a processor component the same as or similar to the field measurement component 106 (Shown in FIG. 1 and described herein).

At operation 208, the well models for the multiple wells in the field may be calibrated based on the field measurement information. In some implementations, operation 208 may be performed by a processor component the same as or similar to the well model calibration component 108 (Shown in FIG. 1 and described herein).

At operation 210, the field model may be calibrated based on the field measurement information. In some implementations, operation 210 may be performed by a processor component the same as or similar to the field model calibration component 110 (Shown in FIG. 1 and described herein).

At operation 212, values of operation parameters for the multiple wells in the field may be determined based on the calibrated well models and the calibrated field model. In some implementations, operation 212 may be performed by a processor component the same as or similar to the operation parameter component 112 (Shown in FIG. 1 and described herein).

At operation 214, automatic operations of the multiple wells in the field may be facilitated based on the determined values of the operation parameters. In some implementations, operation 214 may be performed by a processor component the same as or similar to the operation component 114 (Shown in FIG. 1 and described herein).

Although the system(s) and/or method(s) of this disclosure have been described in detail for the purpose of illustration based on what is currently considered to be the most practical and preferred implementations, it is to be understood that such detail is solely for that purpose and that the disclosure is not limited to the disclosed implementations, but, on the contrary, is intended to cover modifications and equivalent arrangements that are within the spirit and scope of the appended claims. For example, it is to be understood that the present disclosure contemplates that, to the extent possible, one or more features of any implementation can be combined with one or more features of any other implementation.

What is claimed is:

1. A system for controlling operation of multiple wells, the system comprising:

one or more physical processors configured by machine-readable instructions to:

obtain well model information, the well model information defining well models for multiple wells in a physical field, the multiple wells including multiple gas lift wells, the physical field including a first central tank battery, a first production header and a second production header connected to the first central tank battery, a first gas lift well and a second gas lift well connected to the first production header, and a third gas lift well and a fourth gas lift well connected to the second production header, wherein a given gas lift well of the multiple gas lift wells is operated using an initial gas lift gas rate based on allocation of gas lift gas rates to the multiple gas lift wells, the gas lift gas rates for the multiple gas lift wells including rates at which gas is injected into the multiple gas lift wells to drive production in the multiple gas lift wells;

obtain field model information, the field model information defining a field model for the physical field, the field model simulating connections between the multiple wells in the physical field;

obtain field measurement information, the field measurement information defining operation characteristics of the multiple wells in the physical field;

calibrate the well models for the multiple wells in the physical field based on the field measurement information;

calibrate the field model based on the field measurement information;

determine values of operation parameters for the multiple wells in the physical field based on the calibrated well models and the calibrated field model, the operation parameters for the multiple wells in the physical field including the gas lift gas rates for the multiple gas lift wells, wherein determination of the values of the operation parameters for the multiple wells in the physical field based on the calibrated well models and the calibrated field model includes determination of a performance curve tree for the physical field, the performance curve tree including a performance curve for the first production header, a performance curve for the second production header, and a performance curve for the first central tank battery, further wherein:

the performance curve for the first production header is determined based on incremental distribution of gas lift gas rates among the first gas lift well and the second gas lift well connected to the first production header;

the performance curve for the second production header is determined based on incremental distribution of gas lift gas rates among the third gas lift well and the fourth gas lift well connected to the second production header;

the performance curve for the first central tank battery is determined based on incremental distribution of gas lift gas rates among the first production header and the second production header connected to the first central tank battery; and the allocation of gas lift gas rates to the multiple gas lift wells in the physical field is updated based on the performance curve tree for the physical field, wherein the updated allocation of gas lift gas rates to the multiple gas lift wells includes an updated gas lift gas rate for the given gas lift well, the updated gas lift gas rate different from the initial gas lift gas rate for the given gas lift well; and reallocate the gas lift gas rates to the multiple gas lift wells to match the updated allocation of gas lift gas rates determined from the performance curve tree for the physical field, wherein the reallocation of the gas lift gas rate changes the operation of the given gas lift well from the initial gas lift gas rate to the updated gas lift gas rate.

2. The system of claim 1, wherein the field measurement information includes real time sensor measurements or well test measurements.

3. The system of claim 1, wherein the rate at which gas is injected into the given gas lift well to drive production in the gas lift well includes a rate which gas is injected into a production tubing of the given gas lift well to reduce hydrostatic pressure of fluid column in the given gas lift well.

4. The system of claim 1, wherein the multiple wells further include multiple electrical submersible pump wells, and the operation parameters for the multiple wells in the physical field further include electrical submersible pump frequency for the multiple electrical submersible pump wells.

5. The system of claim 1, wherein calibration of a given well model for a given ESP well in the physical field based on the field measurement information includes determination of an ESP pump's gas separation efficiency and wear factor for the given well model.

6. The system of claim 1, wherein calibration of a given well model for a given well in the physical field based on the field measurement information includes determination of a vertical lift performance correlation for the given well model based on comparison between pressure drop in a tubing simulated by the given well model and measured tubing pressure drop of the given well.

7. The system of claim 1, wherein calibration of a given well model for a given well in the physical field based on the field measurement information includes adjustment of reservoir pressure and productivity index for the given well model based on comparison between an operating point simulated by the given well model and a measured operating point of the given well.

8. The system of claim 7, wherein one or more inflow performance relationship calibration rules define extent of reservoir pressure and productivity index adjustment based on the measured operating point of the given well.

9. The system of claim 1, wherein the values of the operation parameters for the multiple wells in the physical field are determined further based on constraints at individual wells, individual production headers, and individual central tank batteries in the physical field.

10. The system of claim 9, wherein the constraints at the individual wells include a minimum gas lift gas rate and a maximum gas lift gas rate, the constraints at the individual production headers include gas available at the individual production headers for gas injection, and the constraints at the individual central tank batteries include gas available at the individual central tank batteries for gas injection.

11. The system of claim 1, wherein a given performance curve for a given well is determined based on isolation of a given well model corresponding to the given well in the field model and calculation of liquid rate at different gas lift gas rates, and increase in production rate from allocation of incremental increase in gas lift gas rate to the given well is determined based on the given performance curve for the given well.

12. The system of claim 1, wherein:

the physical field further includes a second central tank battery;

the performance curve tree further includes a performance curve for the second central tank battery; and the performance curve for the second central tank battery is determined based on incremental distribution of gas lift gas rates among production headers connected to the second central tank battery, different parts of the performance curve for the second central tank battery associated with allocation of incremental increase in gas lift gas rate to a particular production header connected to the second central tank battery.

13. The system of claim 12, wherein:

the performance curve tree further includes an overall performance curve for the physical field; and the overall performance curve for the physical field is determined based on incremental distribution of gas lift gas rates among central tank batteries in the physical field, different parts of the overall performance curve for the physical field associated with allocation of incremental increase in gas lift gas rate to a particular central tank battery in the physical field.

14. The system of claim 1, wherein:

an incremental increase in gas lift gas rate in the first central tank battery is allocated to the first production header over the second production header based on allocation to the first production header resulting in greater increase in production rate than allocation to the second production header and allocated to the second production header over the first production header based on allocation to the second production header resulting in greater increase in production rate than allocation to the first production header;

responsive to allocation of the incremental increase in gas lift gas rate in the first central tank battery to the first production header, the incremental increase in gas lift gas rate in the first production header is allocated to the first gas lift well over the second gas lift well based on allocation to the first gas lift well resulting in greater increase in production rate than allocation to the second gas lift well; and responsive to allocation of the incremental increase in gas lift gas rate in the first central tank battery to the second production header, the incremental increase in gas lift gas rate in the second production header is allocated to the third gas lift well over the fourth gas lift well based on allocation to the third gas lift well resulting in greater increase in production rate than allocation to the fourth gas lift well.

15. A method for controlling operation of multiple wells, the method comprising:

obtaining well model information, the well model information defining well models for multiple wells in a physical field, the multiple wells including multiple gas lift wells, the physical field including a first central tank battery, a first production header and a second production header connected to the first central tank battery, a first gas lift well and a second gas lift well connected to the first production header, and a third gas lift well and a fourth gas lift well connected to the second production header, wherein a given gas lift well of the multiple gas lift wells is operated using an initial gas lift gas rate based on allocation of gas lift gas rates to the multiple gas lift wells, the gas lift gas rates for the multiple gas lift wells including rates at which gas is injected into the multiple gas lift wells to drive production in the multiple gas lift wells;

obtaining field model information, the field model information defining a field model for the physical field, the field model simulating connections between the multiple wells in the physical field;

obtaining field measurement information, the field measurement information defining operation characteristics of the multiple wells in the physical field;

calibrating the well models for the multiple wells in the physical field based on the field measurement information;

calibrating the field model based on the field measurement information;

determining values of operation parameters for the multiple wells in the physical field based on the calibrated well models and the calibrated field model, the operation parameters for the multiple wells in the physical field including the gas lift gas rates for the multiple gas lift wells, wherein determining the values of the operation parameters for the multiple wells in the physical field based on the calibrated well models and the calibrated field model includes determining a performance curve tree for the physical field, the performance curve tree including a performance curve for the first production header, a performance curve for the second production header, and a performance curve for the first central tank battery, further wherein:

the performance curve for the first production header is determined based on incremental distribution of gas lift gas rates among the first gas lift well and the second gas lift well connected to the first production header;

the performance curve for the second production header is determined based on incremental distribution of gas lift gas rates among the third gas lift well and the fourth gas lift well connected to the second production header;

the performance curve for the first central tank battery is determined based on incremental distribution of gas lift gas rates among the first production header and the second production header connected to the first central tank battery; and the allocation of gas lift gas rates to the multiple gas lift wells in the physical field is updated based on the performance curve tree for the physical field, wherein the updated allocation of gas lift gas rates to the multiple gas lift wells includes an updated gas lift gas rate for the given gas lift well, the updated gas lift gas rate different from the initial gas lift gas rate for the given gas lift well; and reallocating the gas lift gas rates to the multiple gas lift wells to match the updated allocation of gas lift gas rates determined from the performance curve tree for the physical field, wherein the reallocation of the gas lift gas rate changes the operation of the given gas lift well from the initial gas lift gas rate to the updated gas lift gas rate.

16. The method of claim 15, wherein the multiple wells further include multiple electrical submersible pump wells, and the operation parameters for the multiple wells in the physical field further include electrical submersible pump frequency for the multiple electrical submersible pump wells.

17. The method of claim 15, wherein calibrating a given well model for a given ESP well in the physical field based on the field measurement information includes determining an ESP pump's gas separation efficiency and wear factor for the given well model.

18. The method of claim 15, wherein the values of the operation parameters for the multiple wells in the physical field are determined further based on constraints at individual wells, individual production headers, and individual central tank batteries in the physical field.

19. The method of claim 18, wherein the constraints at the individual wells include a minimum gas lift gas rate and a maximum gas lift gas rate, the constraints at the individual production headers include gas available at the individual production headers for gas injection, and the constraints at the individual central tank batteries include gas available at the individual central tank batteries for gas injection.

20. The method of claim 15, wherein:

an incremental increase in gas lift gas rate in the first central tank battery is allocated to the first production header over the second production header based on allocation to the first production header resulting in greater increase in production rate than allocation to the second production header and allocated to the second production header over the first production header based on allocation to the second production header resulting in greater increase in production rate than allocation to the first production header;

responsive to allocation of the incremental increase in gas lift gas rate in the first central tank battery to the first production header, the incremental increase in gas lift gas rate in the first production header is allocated to the first gas lift well over the second gas lift well based on allocation to the first gas lift well resulting in greater increase in production rate than allocation to the second gas lift well; and responsive to allocation of the incremental increase in gas lift gas rate in the first central tank battery to the second production header, the incremental increase in gas lift gas rate in the second production header is allocated to the third gas lift well over the fourth gas lift well based on allocation to the third gas lift well resulting in greater increase in production rate than allocation to the fourth gas lift well.

* * * * *